US005248949A

United States Patent [19]

Eguchi et al.

[11] Patent Number: 5,248,949

[45] Date of Patent: Sep. 28, 1993

[54] FLAT TYPE DIELECTRIC FILTER

[75] Inventors: Kazuhiro Eguchi, Miyazaki; Fumio Fukushima, Kawasaki; Koji Nishimura, Miyazaki; Katsumi Sasaki, Miyazaki; Takehiko Yoneda, Miyazaki; Hiromitsu Taki, Miyazaki, all of Japan

[73] Assignee: Matsushita Electric Industrial Co., Ltd., Osaka, Japan

[21] Appl. No.: 850,279

[22] Filed: Mar. 12, 1992

[30] Foreign Application Priority Data

Mar. 13, 1991 [JP] Japan ..... 3-047887

[51] Int. Cl.[5] ..... H01P 1/203

[52] U.S. Cl. ..... 333/204; 333/246

[58] Field of Search ..... 333/202–205, 333/219, 238, 246; 29/592.1, 600

[56] References Cited

U.S. PATENT DOCUMENTS 4,578,656 3/1986 Lacour et al. ..... 333/204
4,583,064 4/1986 Makimoto et al. ..... 333/219
5,055,809 10/1991 Sagawa et al. ..... 333/219

FOREIGN PATENT DOCUMENTS 0204801 8/1988 Japan ..... 333/204

OTHER PUBLICATIONS

Jokela, "Narrow-Band stripline filters . . . at finite frequencies", circuit Theory & Applications, vol. 7, No. 4, Oct. 1979, pp. 445–461.

*Primary Examiner*—Steven Mottola
*Assistant Examiner*—Seung Ham
*Attorney, Agent, or Firm*—Pollock, VandeSande & Priddy

[57] ABSTRACT

A flat type dielectric filter comprises a substantially U-shaped strip line formed such that each center frequency of spurious output deviates from each odd number frequency times the center frequency of the dielectric filter. That is, it comprises a first portion so curved to form an open loop and two second portions formed to have a larger width than the first portion, each of the second portions being provided to an end of the first portion such that each extends in the opposite direction to the other. In this filter, input/output electrodes confronting ends of U-shaped strip line can be formed on a different layer from the layer where the resonator is formed in order to reduce its size. Reduction of size can be obtained by vertically folding the U-shaped strip line extending horizontally. Terminals of this filter formed on the side surface have a first layer formed on the side surface and a second layer formed on the first layer. The first layer is made of silver, the second layer nickel, or the first layer copper, the second layer solder. This filter has two conducting plates sandwiching dielectric substrates including each resonator, the conducting plate being coated with a epoxy resin or dielectric substance.

31 Claims, 13 Drawing Sheets

FIG. 1A
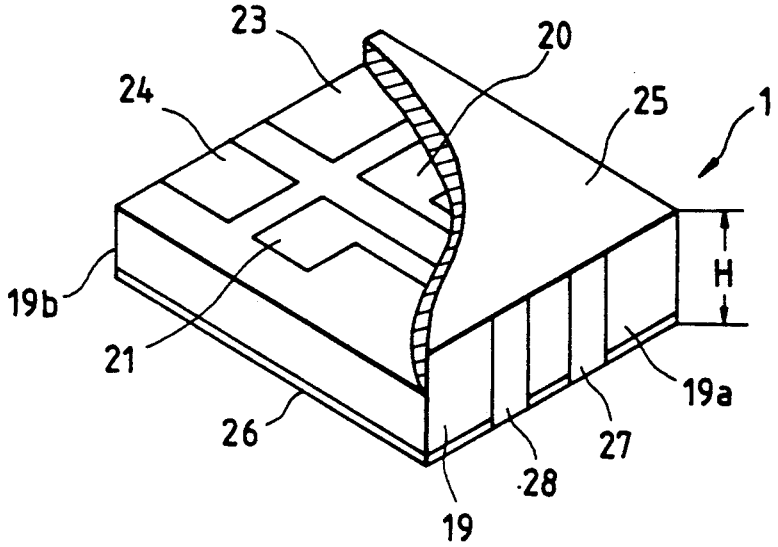
FIG. 1B
FIG. 1C
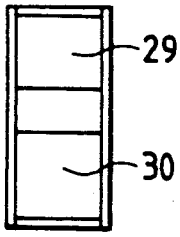
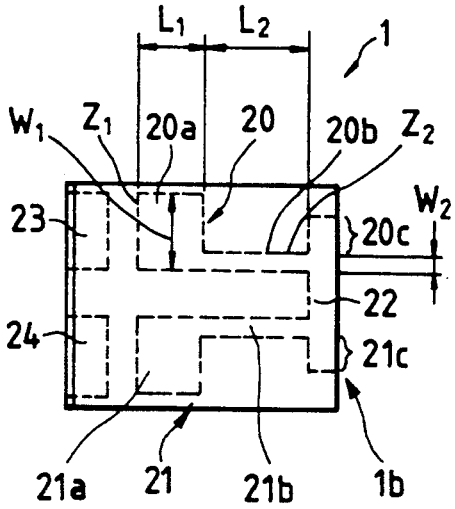
FIG. 1D
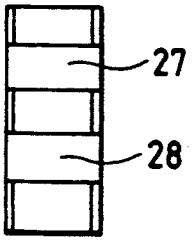

FLAT TYPE DIELECTRIC FILTER

BACKGROUND OF THE INVENTION

The present invention relates to a flat type dielectric filter and particularly to a flat type dielectric filter for a radio apparatus or a measurement instrument.

Description of the Prior Art

A filter used at a high frequency band is known which comprises resonators having inductors and capacitors of lumped constant elements. Another filter used at a high frequency band is known which comprises a resonator portion having coaxial type dielectric resonators. However, there is a problem that the former has an extremely low unloaded Q. In the latter, there is also a problem that a lot of parts are necessary, such as capacitors for input and output portions and for coupling between stages, a case, metal terminals and the like, so that its structure is complicated; it is costly; and its size tends to be large.

A small-sized flat type dielectric filter is developed as an improved filter against these filters, which comprises strip lines.

Hereinbelow will be described a prior art flat type dielectric filter.

FIG. 11A is a partially cutaway view in perspective of a prior art flat type dielectric filter 100. FIG. 11B is a plan view of the prior art flat type dielectric filter 100. FIG. 11C is a side view of FIG. 11B. FIG. 11D is a side view of FIG. 11B from the opposite side. Quarter wavelength strip lines 102 and 103 are formed in a dielectric substrate made of alumina to which $SiO_2$, PbO, or the like of alkaline metallic oxide is added. The strip lines 102 and 103 are connected by a shorting conductor (strip line) 104. A portion of the shorting conductor 104 is exposed at a side end surface 101*a*. Input/output electrodes 105 and 106 are formed in the same plane as the strip conductors 102 and 103 are included. They confront the strip lines 102 and 103 respectively and third portions are exposed at another side end surface 101*b* which is opposite to the side end surface 101*a*. The dielectric substrate 101 is sandwiched between grounded conductors 107 and 108. Therefore, side surface conductors 109 and 110 formed on the side end surface 101*a* connect the grounded conductors 107 and 108. The grounded conductors 107 and 108 extend toward the end surface 101*b* but do not reach the end surface 101*b*. Side conductors 111 and 112 are formed on the side end surface 101*b* are connected to the input/output electrodes 105 and 106 respectively but are not connected to the grounded conductors 107 and 108 because the grounded conductors 107 and 108 do not reach the side end surface 101*b*. These strip lines 102, 103, and 104 form a resonator in the dielectric substrate 101. The strip lines 102 and 103 are capacitively coupled to the input/output electrodes 105 and 106 respectively.

FIG. 12 shows an equivalent circuit diagram of this prior art flat type dielectric filter 100.

FIG. 13 shows a frequency characteristic of this prior art flat type dielectric filter 100. As clearly shown in FIG. 13, spurious output occurs at a frequency for every odd number multiplied by the center frequency of the passband.

Hereinbelow will be described a method of producing the prior art flat type dielectric filter shown in FIGS. 14 and 15.

FIG. 14 is a perspective view of the prior art filter 100 processed in a first step. FIG. 15 is a perspective view of the prior art filter 100 processed in a second step.

At first, as shown in FIG. 14, the grounded conductor 107 is formed on a top surface of the dielectric substrate 101*c*. On the other hand, the grounded conductor 108 is formed on a bottom surface of the dielectric substrate 109. Then, on the top surface of the dielectric substrate 101*d*, the strip lines 102 and 103, the shorting conductor 104, and input/output electrodes 105 and 106 are formed. Then, the dielectric substrate 101*c* is put on the dielectric substrate 101*d* such that the bottom surface of the dielectric substrate 101*c* confronts the top surface of the dielectric substrate 101*d*. A pressure from 0.1 Kg to hundreds of Kg per 1 $cm^2$ is applied to a mass of the dielectric substrates 101*c* and 101*d* for ten seconds to one minute. The compressed mass of the dielectric substrates 101*c* and 101*d* is sintered at a temperature from 750° to 900° for thirty minutes to two hours. This causes reaction between the dielectric substrates 101*c* and 101*d* such that a border between these dielectric substrates 101*c* and 101*d* disappears. At the second step of forming the filter 100, on the side surface of the integrated dielectric substrates 101*c* and 101*d*, side surface conductors 109 and 110 and on the opposite side surface, the side surface conductors (not shown) are formed as shown in FIG. 15 to complete the dielectric filter 100.

In the prior art flat type dielectric filter mentioned above, there is a problem that it cannot remove frequency components around respective odd number times frequencies. This is important because generally, in the radio apparatus or measuring instruments used at a radio wave frequency band, there is a tendency that spurious output occurs at a frequency for every odd number multiplied by the center frequency of the passband used in these apparatus.

In addition to this, there is another problem that the prior art flat type dielectric filter is relatively large in size. There is a further problem in that in the prior art flat type dielectric filter, terminals exposed are subject to corrosion. There is a further problem that in the prior art flat type dielectric filter, the exposed grounded conductors are subject to deterioration.

SUMMARY OF THE INVENTION

The present invention has been developed in order to remove the above-described drawbacks inherent to the conventional flat type dielectric filter.

According to the present invention there is provided a first flat type dielectric filter comprising: a substantially U-shaped strip line, the strip line being formed such that the spurious output at each frequency of spurious response deviates from each frequency that is an odd number multiplied by the center frequency of passband of the dielectric filter.

According to the present invention there is also provided a second flat type dielectric filter as mentioned in the first flat type dielectric filter, wherein the strip line comprises: a first portion so curved to form an open loop; and two second portions formed to have larger widths than the first portion, each provided to one of the second portions being end of the first portion such that each of the second portions extends in the opposite direction to the other.

According to the present invention there is further provided a third flat type dielectric filter comprising: a first layer dielectric substrate having a substantially U-shaped strip line; and a second layer dielectric substrate formed on the first layer dielectric substrate, the second layer dielectric substrate having two electrode portions located such that they confront ends of the U-shaped strip line to have capacitive coupling respectively.

According to the present invention there is also provided a fourth flat type dielectric filter comprising: a first layer dielectric substrate having a resonator thereon, the resonator having an open loop strip line, each end of the open loop strip line extends to an edge of the first layer dielectric substrate; and a second layer dielectric substrate formed on the first layer dielectric substrate, the second layer dielectric substrate having two strip lines thereon, and side surface conductors formed on a side surface of the second layer dielectric substrate such that each end of the open loop strip line is connected to each of the strip lines; and a third layer dielectric substrate formed on the second layer dielectric substrate, the third layer dielectric substrate having two electrode portions located such that they confront the strip lines to have capacitive coupling respectively.

According to the present invention there is further provided a fifth flat type dielectric filter comprising: a first and second dielectric substrates; a substantially U-shaped strip line formed on the first dielectric substrate; two input/output electrodes formed on the first dielectric substrate, each confronting each end of the U-shaped strip line, each extending to an edge of the first dielectric substrate, the strip line and the two input/output electrodes sandwiched between the first and second dielectric substrates; two conducting plates sandwiching the first and second dielectric substrates; and two terminal portions formed on a side surface defined by the edge such that each is connected to each of the two input/output electrodes, each of the two terminal portions comprising a first layer formed on the side surface and a second layer formed the first layer.

According to the present invention there is also provided a sixth flat type dielectric filter as mentioned in the fifth flat type dielectric filter wherein the first layer is made of silver and the second layer is made of nickel.

According to the present invention there is further provided a seventh flat type dielectric filter as mentioned in the fifth flat type dielectric filter, further comprising a coat layer for coating over at least the two conducting plates;

BRIEF DESCRIPTION OF THE DRAWINGS

The object and features of the present invention will become more readily apparent from the following detailed description taken in conjunction with the accompanying drawings in which:

FIG. 1A is a partially cutaway view in perspective of a first embodiment;

FIG. 1B is a plan view of the first embodiment;

FIG. 1C is a side view of FIG. 1B;

FIG. 10 is a side view of FIG. 1B from the opposite side;

The same or corresponding elements or parts are designated as like references throughout the drawings.

DETAILED DESCRIPTION OF THE INVENTION

Figure 2:
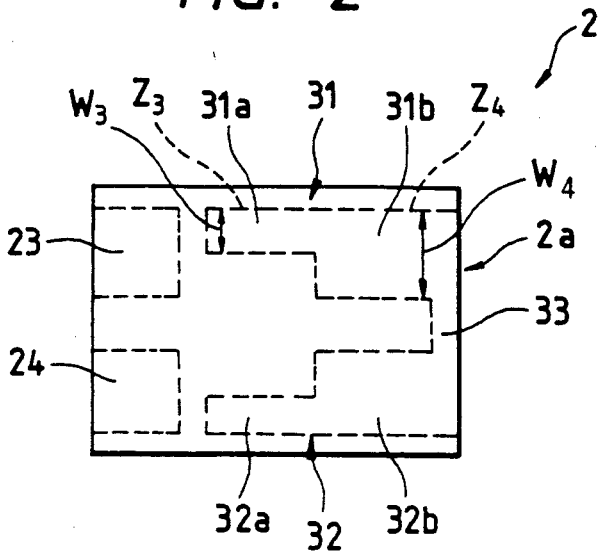
FIG. 2 is a plan view of a second embodiment of the flat type dielectric filter.

Hereinbelow will be described a first embodiment of this invention with reference to drawings. FIG. 1A is a partially cutaway view in perspective of the first embodiment. FIG. 1B is a plan view of the first embodiment. FIG. 1C is a side view of FIG. 1B. FIG. 1C is a side view of FIG. 1B from the opposite side.

Quarter wavelength strip lines (balanced-strip lines) 20 and 21 are formed in a dielectric substrate 19 made of alumina to which $SiO_2$, PbO, or the like of alkaline metallic oxide is added. In this specification, embodiments are described about dielectric filters comprising balanced-strip lines. However, this invention can be applied to dielectric filters comprising microstrips. The strip lines 20 and 21 are connected by a shorting conductor (strip line) 22. Input/output electrodes 23 and 24 are formed on the same plane as the strip lines 20 and 21 are formed. The strip line 20 comprises a first portion **20*a* having a first width $W_1$ confronting the input/output electrode 23, a second portions 20*b* having a second width $W_2$ which is smaller than the first width $W_1$, and a third portion 20c having a third width which is larger than the second width $W_2$ but smaller than the first width $W_1$. The strip line 21 comprises a first portion 21a having a first width $W_1$ confronting to the input/output electrode 24, a second portion 21b having a second width $W_2$, and a third portion 21c having the third width. That is, the resonators 1b are formed in a $\pi$ -shape. The input/output electrodes 23 and 24 have the substantially same width as the first width $W_1$ of the first portions 20a and 21a. Portions of the strip lines 20c and 21c and the shorting conductor 22 are exposed at a side surface 19a. Portions of the input/output electrodes 23 and 24 are exposed at another side surface 19b which is opposite to the side surface 19a. The dielectric substrate 19 is sandwiched between grounded conductors 25 and 26. Therefore, side surface conductors 27 and 28 formed on the side surface 19a provides connection between the grounded conductor 25 and the shorting conductor 22 and between the shorting conductor 22 and the grounded conductor 26. The grounded conductors 25 and 26 extend toward the side surface 19b but do not reach the side surface 19b. Side conductors 29 and 30 formed on the side surface 19b connected to the input/output electrodes 23 and 24 respectively but are not connected to the grounded conductors 25 and 26 because the grounded conductors 25 and 26 do not reach the side surface 1b. These strip lines 20, 21, and 22 form the resonators 1b in the dielectric substrate 19. The strip lines 20 and 21 are capacitively coupled to the input/output electrodes 23 and 24** respectively.

The strip lines 20 and 21, shorting conductor 22, input/output electrodes 23 and 24, grounded conductor 25 and 26, and side surface conductors 27, 28, 29, and 30 are formed by printing technique or the like. Thicknesses of the strip lines 20, 21, and 22 and input/output electrodes 23 and 24 are from about 4 μm to 10 μm. Thicknesses of the side surface conductors are from 5 μm to 15 μm.

As mentioned, in this embodiment, the strip lines 20 and 21 have three portions 20a, 20b, and 20c whose widths are different from each other, so that each center frequency of the spurious output in the spurious response deviates from each odd number frequency multiplied by the center frequency of the passband.

Assuming that a length of the first portion 20a of the strip line 20 is L1 and a length of the second portion 20b of the strip line 20, L2, which is the same as L1 here, a characteristic impedance of the first portion 20a Z1, and a characteristic impedance of the first portion 20b Z2, the spurious response is experimentally obtained. Table 1 shows the result where a spurious response of the prior art is shown for convenience of comparison.

TABLE 1

| | CTR FREQ OF PASS-BAND [MHz] | Z1 [Ohm] | Z2 [Ohm] | 1ST ORDER SPU-RIOUS OUTPUT [MHz] | 2ND ORDER SPU-RIOUS OUTPUT [MHz] |
|---|---|---|---|---|---|
| PRIOR ART | 900 | 18.7 | 18.7 | 2715 | 4523 |
| FIG. 1 | 900 | 14.0 | 46.8 | 3927 | 5928 |
| FIG. 2 | 900 | 46.8 | 14.0 | 2210 | 3745 |

Figure 11A:
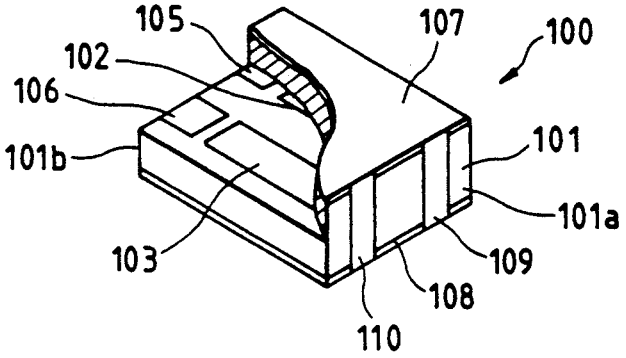
FIG. 11A PRIOR ART
FIG. 11A is a partially cutaway view in perspective of a prior art flat type dielectric filter.
Figure 11C:
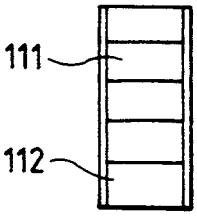
FIG. 11C PRIOR ART
FIG. 11C is a side view of prior art shown in FIG. 11B.
Figure 11B:
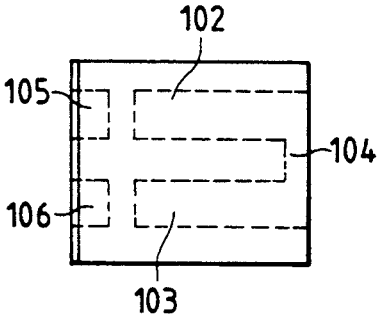
FIG. 11B PRIOR ART
FIG. 11B is a plan view of the prior art flat type dielectric filter.
Figure 11D:
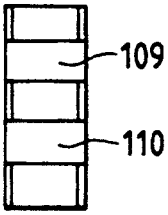
FIG. 11D PRIOR ART
FIG. 11D is a side view of prior art shown in FIG. 11B from the opposite side.
Figure 12:
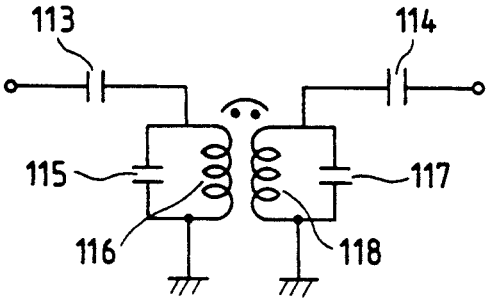
FIG. 12 PRIOR ART
FIG. 12 shows an equivalent circuit diagram of this prior art flat type dielectric filter.
Figure 13:
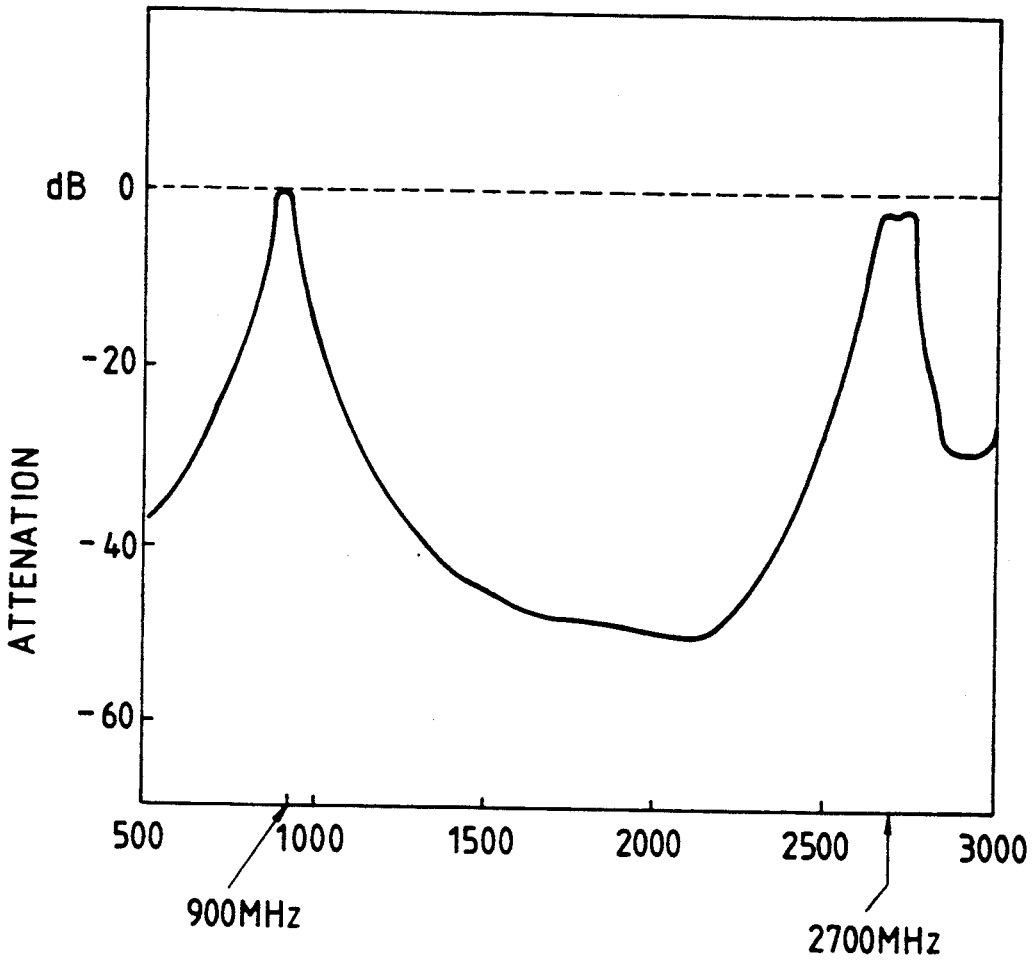
FIG. 13 PRIOR ART
FIG. 13 shows a frequency characteristic of the prior art flat type dielectric filter.
Figure 14:
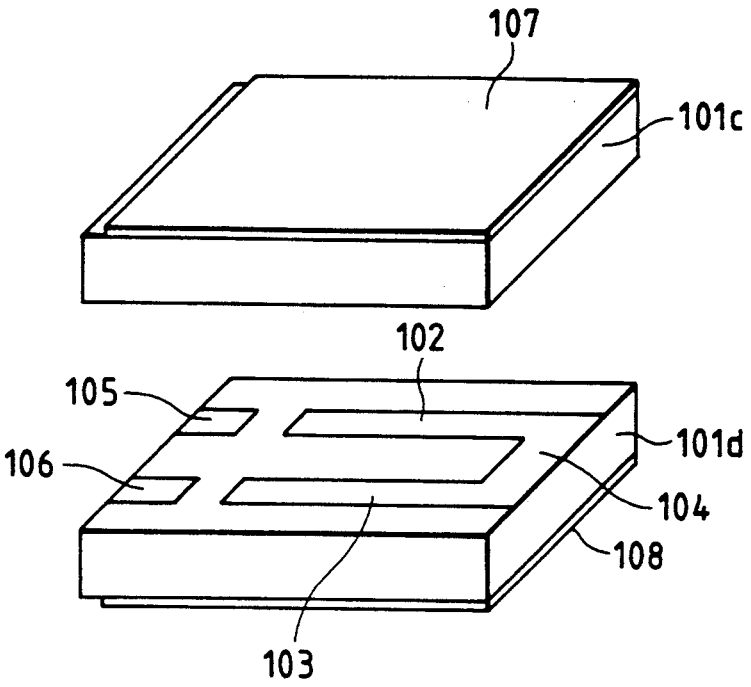
FIG. 14 PRIOR ART
FIG. 14 is a perspective view of the prior art filter processed in a first step.
Figure 15:
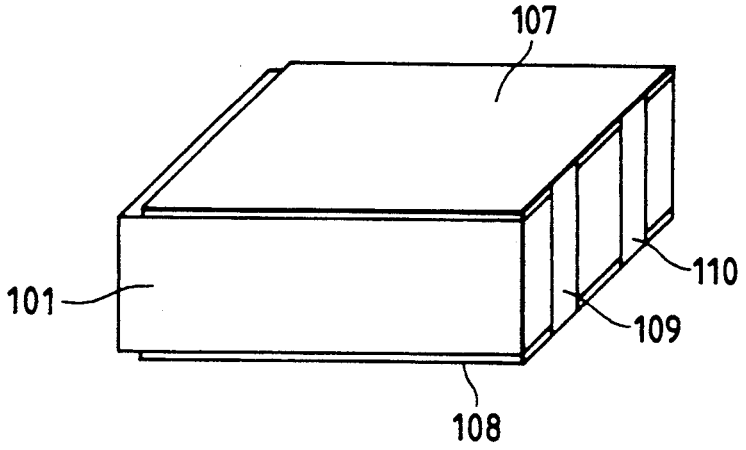
FIG. 15 PRIOR ART
FIG. 15 is a perspective view of the prior art filter processed in a second step.

As shown in Table 1, in the prior art shown in FIG. 11A, spurious output occurs at frequencies of about three and five times center frequency of the passband. On the other hand, according to this embodiment, spurious output occurs at frequencies of about 4.4 and 6.6 times the center frequency of the passband. That is, each center frequency of spurious output deviates from each frequency of odd number times the center frequency of the passband. This fact shows that an effective filter is provided.

More specifically, it is assumed that the width of the first portion 20a is $W_1$; the width of the second potion 20b is $W_2$; and a height of the dielectric filter 1 is H. Then, the impedance $Z_1$ is given by:

$$Z_1=30\pi/\{(\epsilon_r)^{\frac{1}{2}}.(W_1/H+(2/\pi)1n2)\} \quad (1)$$

The impedance $Z_2$ is given by:

$$Z_2=30\pi/\{(\epsilon_r)^{\frac{1}{2}}.(W_2/H+(2/\pi)1n2)\} \quad (2)$$

Therefore, assuming $K=Z_1/Z_2$, the spurious output frequency $f_{51}$ is given by:

$$f_{01}/f_0=\}\pi/\tan^{-1}(K)^{\frac{1}{2}}\}-1 \quad (3)$$

wherein $\epsilon_r$ is a dielectric constant of the dielectric substrate 19 and $f_o$ is a fundamental frequency that is a resonance frequency of the resonators 1b or the center frequency of the passband of the filter 1.

Therefore, assuming K is 0.95 to 0.55 or 0.50 to 0.25, the spurious output center frequency deviates from a frequency N times the center frequency of the passband (N is a natural number). That is, each center frequency of spurious output deviates from each frequency odd number times the center frequency of the passband.

Hereinbelow will be described a method of producing the flat type dielectric filter 1. Basically, this method is used commonly in all embodiments throughout the specification. For example, the methods of producing the flat type dielectric filter 1 of the first embodiment is described. The different point among embodiments of this specification is in the shape of the strip lines. Thus, the only method for producing the flat type dielectric filter 1a of the first embodiment will be described. In the sixth and seventh embodiments, the dielectric filters are produced by methods obtained by modification of this method.

Figure 6A:
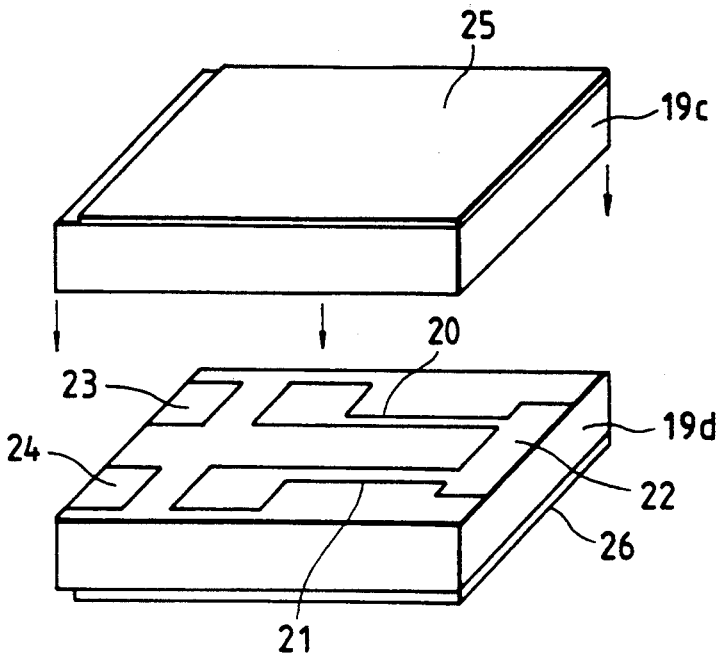
FIG. 6A is a perspective view of a flat type dielectric filter of the first embodiment processed in a first step.
Figure 6B:
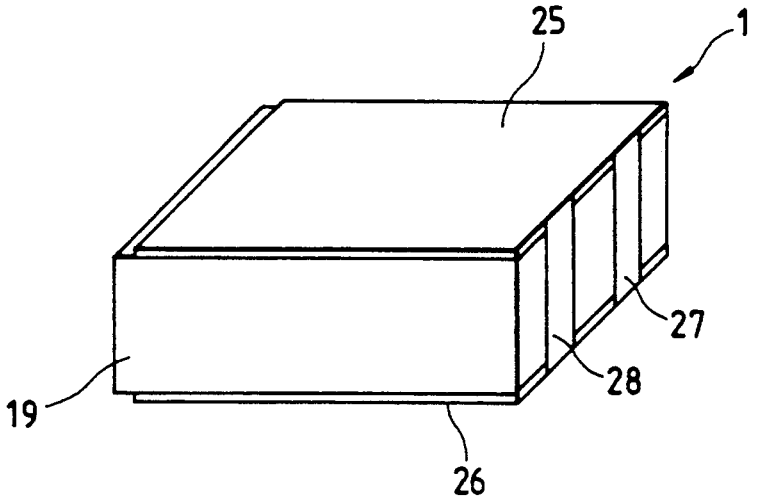
FIG. 6B is a perspective view of a dielectric filter of the first embodiment processed in a second step.

FIG. 6A is a perspective view of the filter 1a of the first embodiment in a first step. FIG. 6B is a perspective view of the filter 1 at a second step.

At first, as shown in FIG. 6A, the grounded conductor 25 is formed on a top surface of the dielectric substrate 19c. On the other hand, the grounded conductor 26 is formed on a bottom surface of the dielectric substrate 19d. Then, on the top surface of the dialectic substrate 19d, the strip lines 20 and 21, the shorting conductor 22, and input/output electrodes 23 and 24 are formed. Then, the dielectric substrate 19c is put on the dielectric 19d such that the bottom surface of the dielectric 19c confronts the top surface of the dielectric substrate 19d. A pressure from 0.1 Kg to hundreds Kg per 1 $cm^2$ is applied to a mass of the dielectric substrates 19c and 19d for ten seconds to one minute by a hydraulic press machine. The compressed mass of the dielectric substrates 19c and 19d is sintered at a temperature from 750° to 900° for thirty minutes to two hours. This causes reaction between the dielectric substrates 19c and 19d such that a boarder between these dielectric substrates 19c and 19d disappears. At the second step of forming the filter 1, on the side surface of the integrated dielectric substrates 19c and 19d, that is, on a dielectric substrate 19, the side surface conductors 27 and 28 and on the opposite side surface, the side surface conductors 19 and 30 (not shown) are formed as shown in FIG. 6B to complete the dielectric filter 1.

The strip lines 20 and 21, shorting conductor 22, input/output electrodes 23 and 24, grounded conductors 25 and 26, and side surface conductors 27 and 28 are formed by printing technique or the like. That is, a part composed of a conductive material such as Ag or Cu or the like, powder of the material forming the dielectric substrate, a binder, and a solvent are printed on the dielectric substrate 19*d* of 19*c* (made of a ceramic) to have given shapes and then, the printed mass is sintered at a temperature from 800° to 850° for about 5 to 10 minutes. As mentioned above, the example method of production of the dielectric filter 1 is described. However, the method of the production the dielectric filter 1 is not limited to the method mentioned above. Thus, any method providing the form of the strip lines 20 and 21 mentioned above can be used in to this invention.

As mentioned above, the method of production of the dielectric filter 1 is described for example. However, the method of the production the dielectric filter 1 is not limited to the method mentioned above. Thus, any method providing the form of the strip lines 20 and 21 mentioned above is possible to apply to this invention.

Hereinbelow will be described a second embodiment.

FIG. 2 is a plan view of the second embodiment of the flat type dielectric filter 2. Basic structure is the same as that of the first embodiment. There is a difference in the shape of the strip lines. Resonators 2*a* of a flat type dielectric filter 2 comprise strip lines 31 and 32 and shorting conductor (strip line) 33 for connecting these strip lines 31 and 32 to each other, so that the strip lines 31 and 32 and shorting conductor 33 form an open loop. In other words, the resonators 2*a* have a U-shape. Ends of the resonators confront input/output electrode 23 and 24 respectively. The strip line 31 has a first portion 31*a* and second portion 31*b*. One end of the first portion 31*a* confronts the input/output electrode 23 with a given distance. The second portion 31*b* is provided to the other end of the first portion 31*a*. The second portion 31*b* is connected to the shorting conductor 33 at its end portion opposite to the first portion 31*a*.

The strip line 32 has a first portion 32*a* and second portion 32*b*. One end of the first portion 32*a* confronts the input/output electrode 24 with a given distance. The second portion 32*b* is provided to the other end of the first portion 32*a*. The second portion 32*b* is connected to the shorting conductor 33 at its end portion opposite to the first portion 32*a*. Thus, the strip lines 31 and 32 are symmetrically formed. In other words, the resonators 2*a* have the U-shape substantially as mentioned above. Widths $W_3$ of the first portions 31*a* and 32*a* are smaller than widths $W_4$ of the second portions 31*b* and 32*b*. A distance between the first portions 31*a* and 32*b* is larger than that between the second portions 31*b* and 32*b*. Thus, peripheral edges of the first portion 31*a* and the second portion 31*b* form a straight line. Similarly, peripheral edges of the first portion 32*a* and the second portion 32*b* form a straight line also. Therefore, assuming that a characteristic impedance of the first portion 31*a* is $Z_3$ and a characteristic impedance of the second portion 31*b* is $Z_4$, $Z_3 > Z_4$. Spurious output characteristics of the second embodiment is shown in the Table 1.

As shown in the Table 1, spurious outputs occur at frequencies about 2.5 and 4.2 times the center frequency of the passband (a resonance frequency of the resonators 2*a*). That is, each center frequency of spurious output deviates from each frequency odd number times the center frequency of the passband. This fact shows that an effective filter is provided.

More specifically, assuming the width of the first portion 31*a* is $W_3$ and the width of the second portion 31*b* is $W_4$, similar to the first embodiment, if K is 1.05 to 2.95, each center frequency of spurious output deviates from each frequency N times the center frequency of the passband (N is a natural number).

Hereinbelow will be described a third embodiment.

Figure 3:
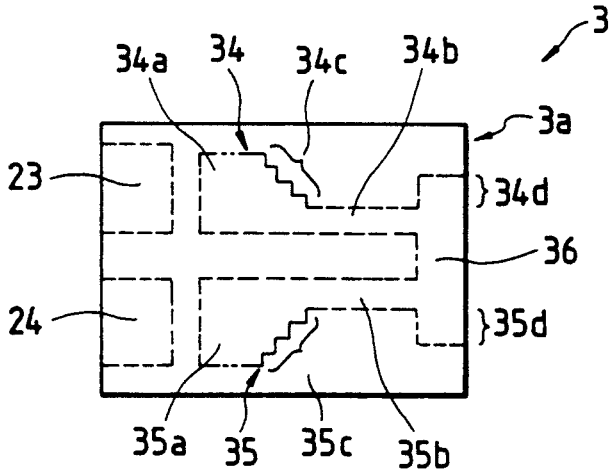
FIG. 3 is a plan view of a third embodiment of the flat type dielectric filter.

FIG. 3 is a plan view of the third embodiment of the flat type dielectric filter 3. Basic structure is the same as that of the first embodiment. There is a difference in the shape of the strip lines. Resonators 3*a* of a flat type dielectric filter 3 comprise strip lines 34 and 35 and shorting conductor (strip line) 36 for connecting these strip lines 34 and 35 to each other, so that strip lines 34 and 35 and shorting conductor 36 form an open loop. In other words, the resonators 3*a* have a U-shape. Ends of the resonators 3*a* confront input/output electrodes 23 and 24 respectively. The strip line 34 has a first portion, second portion 34*b*, and third portion 34*c*. One end of the first portion 34*a* confronts the input/output electrode 23 with a given distance. The second portion 31*b* is connected to the shorting conductor 36 at its end portion opposite to the first portion 34*a*. The first portion 34*a* is connected to the second portion 34*b* by the third portion 34*c*.

The strip line 35 has a first portion 35*a*, second portion 35*b*, and third portion 35*c*. One end of the first portion 35*a* confronts the input/output electrode 24 with a given distance. The second portion 35*b* is connected to the shorting conductor 36 at its end portion opposite to the first portion 35*a*. The first portion 35*a* is connected to the second portion 35*b* by the third portion 35*c*.

Thus, the strip lines 31 and 32 are symmetrically formed. In other words, the resonators 3*a* have a U-shape substantially as mentioned above. Widths of the first portions 34*a* and 34*a* are larger than those of the second portions 34*b* and 35*b*. The width of the first portion 34*a* is equal to one end of the third portion 34*c* and the width of the second portion 34*c* is equal to that of the second portion 34*c*. Thus, each of the widths of the third portion 34*c* decreases with increase in distance from the first portion 34*a*. Meanwhile, the inside edges of the first, second, and third portions 34*a*, 34*b*, and 34*c* form a straight line. That is, only the peripheral edge of the third portion inclines. An inclined peripheral edge of the third portion 34*c* has a staircase shape. However, a straight inclined line is possible.

In the third embodiment, each center frequency of the spurious output deviates from each frequency odd number times the center frequency of the passband, so that an effective filter is provided.

Hereinbelow will be described a fourth embodiment.

Figure 4:
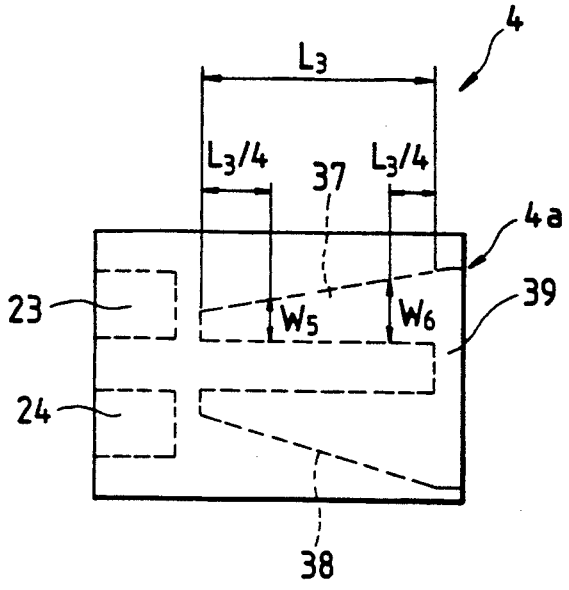
FIG. 4 is a plan view of a fourth embodiment of the flat type dielectric filter.

FIG. 4 is a plan view of the fourth embodiment of the flat type dielectric filter 4. Basic structure is the same as that of the first embodiment. There is a difference in the shape of the strip lines. Resonators 4*a* of a flat type dielectric filter 4 comprise strip lines 37 and 38 and shorting conductor (strip line) 39 for connecting these strip lines 37 and 38 to each other, so that strip lines 37 and 38 and shorting conductor 39 form an open loop. In other words, the resonators 4*a* have a U-shape substantially. Ends of the resonators 4*a* confront input/output electrodes 23 and 24 respectively. The width of the strip line 37 linearly increases with an increase in distance from an end of the strip line 37 which confronts the input/output electrode 23. Similarly, the width of the strip line 38 linearly increases with an increase in distance from an end of the strip line 38 which confronts the input/output electrode 24. However, the distance between the strip line 37 and 38 is constant. That is, peripheral edges of the strip lines 37 and 38 are inclined.

In this embodiment, assuming the width of the strip line 37 at $L_3/4$ from its end ($L_3$ is a length of the strip line 37) is $W_5$ and the width of the strip line 37 at $L_3/4$ from the shorting conductor 39 is $W_6$, similar to the first embodiment, if K is 0.95 to 0.55 or 0.50 to 0.25, each center frequency of spurious output deviates from each frequency N times the center frequency of the passband (N is a natural number).

Hereinbelow will be described a fifth embodiment.

Figure 5:
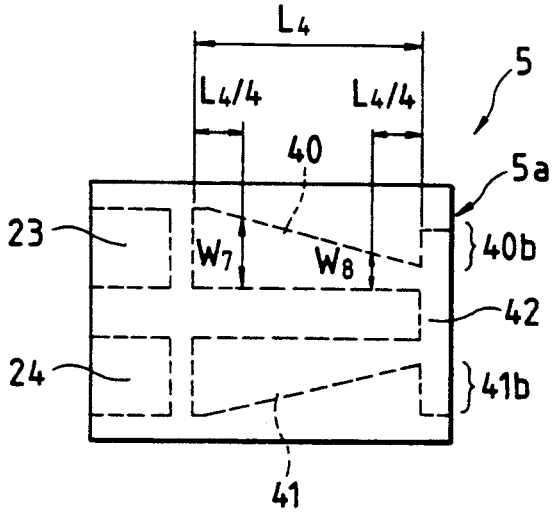
FIG. 5 is a plan view of a fifth embodiment of the flat type dielectric filter.

FIG. 5 is a plan view of the fifth embodiment of the flat type dielectric filter 5. Basic structure is the same as that of the first embodiment. There is a difference in the shape of the strip lines. Resonators 5*a* of a flat type dielectric filter 5 comprise strip lines 40 and 41 and shorting conductor (strip line) 42 for connecting these strip lines 40 and 41 to each other, so that strip lines 40 and 41 and shorting conductor 42 form an open loop. In other words, the resonators 5*a* have a U-shape substantially. Ends of the resonators 5*a* confront input/output electrode 23 and 24 respectively. The width of the strip line 40 linearly decreases with increased distance from an end of the strip line 37 which confronts the input-/output electrode 23. Similarly, the width of the strip line 41 linearly decreases with increased distance from an end of the strip line 38 which confronts the input-/output electrode 24. However, distance between the strip line 40 and 41 is constant. That is, peripheral edges of the strip lines 40 and 41 are inclined.

In this embodiment, assuming the width of the strip line 40 at $L_4/4$ from its end ($L_4$ is a length of the strip line 40) is $W_7$ and the width of the strip line 40 at $L_4/4$ from the shorting conductor 42 is $W_8$, similar to the first embodiment, if K is 1.05 to 2.95 or 3.05 to 8.0, each center frequency of spurious output deviates from each frequency N times the center frequency of the passband (N is a natural number).

Spurious output characteristics of the fourth and fifth embodiments are measured and shown in Table 2.

TABLE 2

| | CTR FREQ OF PASS-BAND [MHz] | 1ST ORDER SPURIOUS OUTPUT [MHz] | 2ND ORDER SPURIOUS OUTPUT [MHz] |
|---|---|---|---|
| FIG. 4 | 900 | 2258 | 3877 |
| FIG. 5 | 900 | 3420 | 5130 |

As shown in the Table 2, according to the fourth embodiment, spurious outputs occur at frequencies of about 2.5 and 4.3 times the center frequency of the passband. According to the fifth embodiment, spurious outputs occur at frequencies of about 3.8 and 5.7 times the center frequency of the passband (resonance frequency of the resonators 5*a*). That is, each center frequency of spurious output deviates from each odd number frequency times the center frequency of the passband, so that an effective filter is provided according to the fourth and fifth embodiment.

Hereinbelow will be described a sixth embodiment.

Figure 7A:
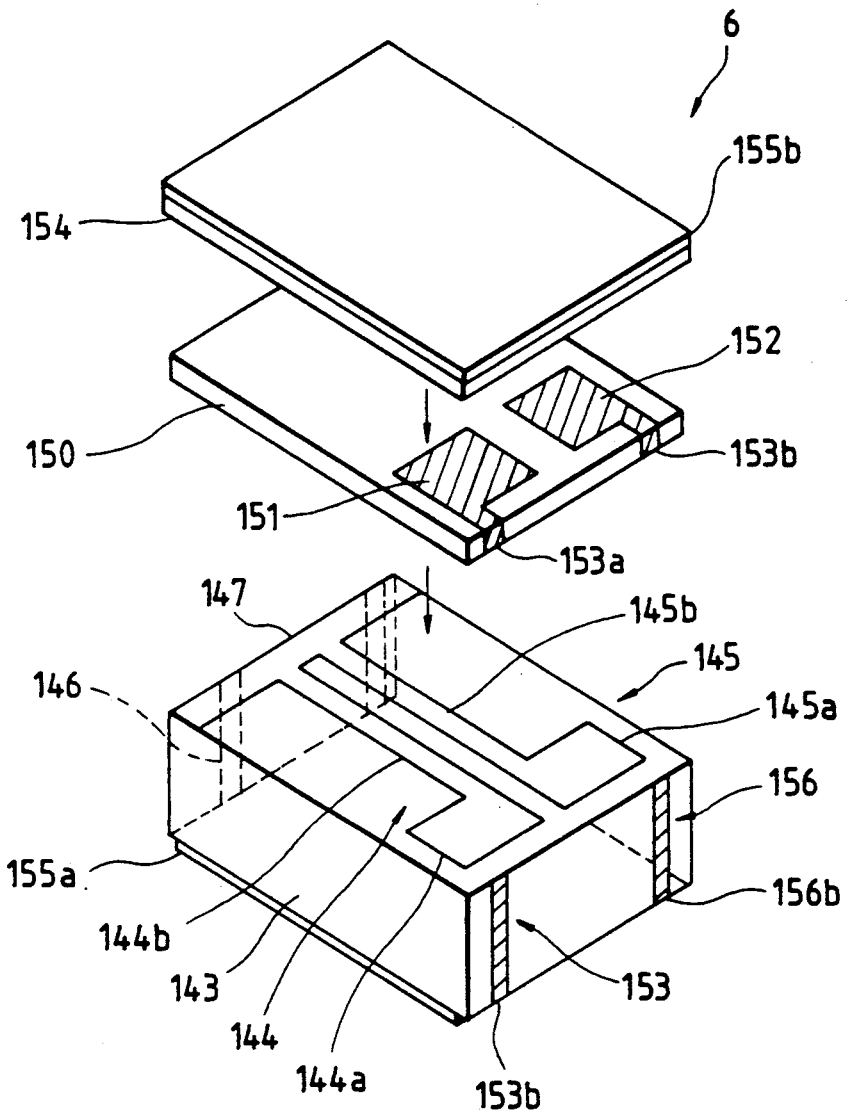
FIG. 7A is a perspective view of a sixth embodiment of the dielectric filter in the condition before the integration processing.
Figure 7B:
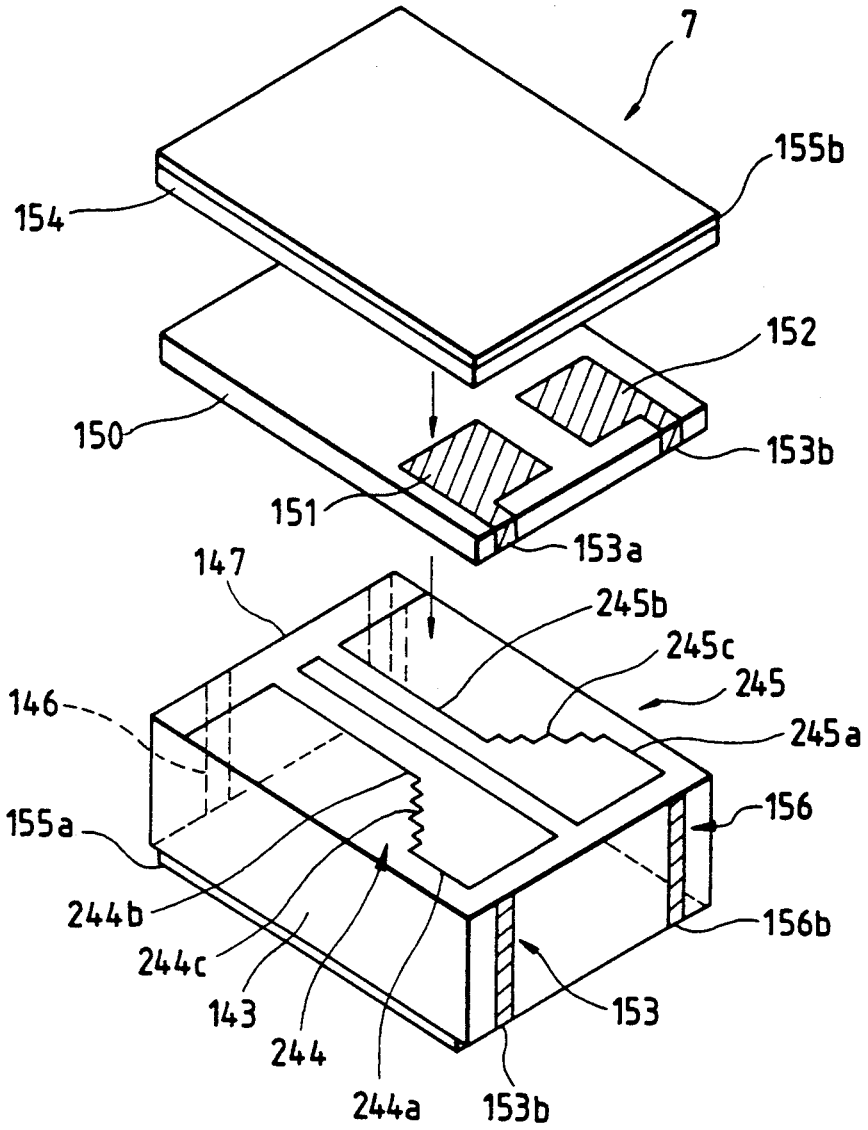
FIG. 7B is a perspective view of a modification of the sixth embodiment.

FIG. 7A is a perspective view of the sixth embodiment of the dielectric filter 6 in the condition before the integration processing. In FIG. 7A, strip lines 144 and 145 are formed on a first layer dielectric substrate 143. The strip line 144 comprises a first portion 144*a* and second portion 144*b* where the width of the first portion 144*a* is larger than that of the second portion 144*b*. Similarly, the strip line 145 comprises a first portion 145*a* and second portion 145*b* where the width of the first portion 145*a* is larger than that of the second portion 145*b*. These strip lines 144 and 145 are connected by a shorting conductor (strip line) 147. The shorting conductor 147 is connected to the grounded conductor 155*a* provided to the bottom surface of the first layer dielectric substrate 143 through the side electrode 146. A second layer dielectric substrate 150 is integrated with the first dielectric substrate 143 by the technique mentioned above. However, on the top of the second layer dielectric substrate 150, input/output electrodes 151 and 152 are formed instead of the grounded conductor. The input/output electrodes 151 and 152 are formed such that they confront the first portions 144*a* and 145*a* respectively when the first layer dielectric substrate 143 is integrated with the second dielectric substrate 150. This produces capacitive coupling therebetween. Side surface conductors 153*a*, 153*b*, 156*a*, and 156*b* are formed after integration of the first dielectric substrate 143 with the second dielectric substrate 150 such that the input terminals 151 and 152 are connected to the side surface terminals 153 and 156. Then, a third layer dielectric substrate 154 is integrated with the integrated substrate of the first dielectric substrate 143 and the second dielectric substrate 150. Over the third layer dielectric substrate 154, a grounded conductor 155*b* is formed. After integration of the third dielectric substrate 154, the side surface conductor 146 is formed in fact. Thus, the grounded conductor 155*b* is connected to the grounded conductor 115*a*. FIG. 7B is a perspective view of the modification of this embodiment of dielectric filter 7 in the condition before the integration processing. The dielectric filter 7 is obtained by modification of this embodiment shown in FIG. 7A by techniques described in the third embodiment (FIG. 3). This is an example embodiment where the respective techniques of the second (FIG. 2), fourth (FIG. 4), and fifth (FIG. 5) embodiments can be applied.

This structure provides a small-sized dielectric filter because the input/output electrodes 151 and 152 are provided above the first portions 144*a* and 145*a*.

Hereinbelow will be described a seventh embodiment.

Figure 8A:
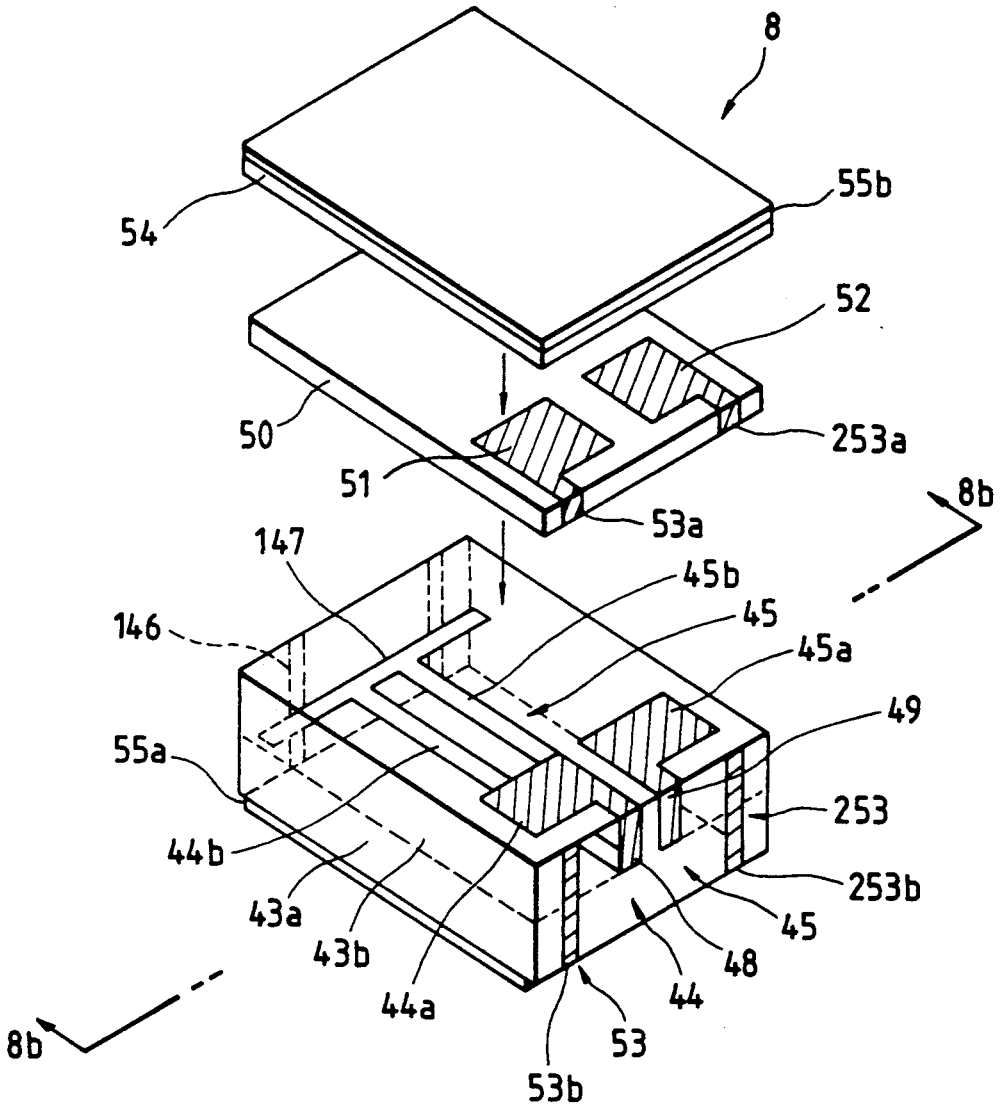
FIG. 8A is a perspective view of a seventh embodiment of the dielectric filter in the condition before the integration processing.

FIG. 8A is a perspective view of the seventh embodiment of the dielectric filter 8 in the condition before the integration processing. In FIG. 8A, strip lines 44*b* and 45*b* are formed on a first layer dielectric substrate 43*a*. These strip lines 44*b* and 45*b* are connected by a shorting conductor (strip line) 147. The shorting conductor 147 is connected to the grounded conductor 55*a* provided to the bottom surface of the first layer dielectric substrate 43*a* through side electrode 146. The first layer dielectric substrate 43*a* is integrated with the second dielectric substrate 43*b* on which strip lines 44*a* and 45*a* are formed. After integration of the first and second dielectric substrates 43*a* and 43*b*, side surface conductors 48 and 49 are formed such that the strip lines 44*a* and 45*a* are connected to strip lines 44*b* and 45*b* respectively. That is, the strip line 44*a* is a first portion of the strip line 44, and the strip line 44*b* and the side surface conductor 48 is a second portion of the strip line 44 as described in the first embodiment. Similarly, the strip line 45a is a first portion of the strip line 45, and the strip line 45b and the side surface conductor 49 is a second portion of the strip line 45. The first portion 44a and second portion 44b are formed such that the width of the first portion 44a is larger than that of the second portion 44b. Similarly, the first portion 45a and second portion 145b are formed such that the width of the first portion 45a is larger than that of the second portion 45b. The first dielectric substrate 43a is integrated with the second dielectric substrate 43b by the technique mentioned in the first embodiment.

The integrated dielectric substrate of the first and second dielectric layer 43a and 43b is integrated with a third dielectric substrate 50 by the technique mentioned in the first embodiment. However, on the top of the third layer dielectric substrate 50, input/output electrodes 51 and 52 are formed instead of the grounded conductor. The input/output electrodes 51 and 52 are formed such that they confront the first portions 44a and 45a respectively when the integrated dielectric substrate of the first and second dielectric substrate 43a and 43b is integrated with the third layer dielectric substrate 50. This produces capacitive coupling therebetween. Side surface conductors 53a, 53b, 256a, and 256b are formed after integration of the integrated dielectric substrate of the first and second layer dielectric substrates 43a and 43b with the third dielectric substrate 50 such that the input terminals 51 and 52 are connected to the side surface terminals 53 and 253. Then, a fourth layer dielectric substrate 54 is integrated with the integrated substrate of the first, second and third dielectric substrates 43a, 43b, and 50. Over the fourth layer dielectric substrate 54, a grounded conductor 55b is formed. After integration of the fourth dielectric substrate 54, the side surface conductor 146 is formed. Thus, the grounded conductor 55b is connected to the grounded conductor 55a.

This structure provides a small-sized dielectric filter because the strip lines 44b and 45b are folded back in addition to that the input/output electrodes 51 and 52 are provided above the first portions 44a and 45a.

Figure 8B:
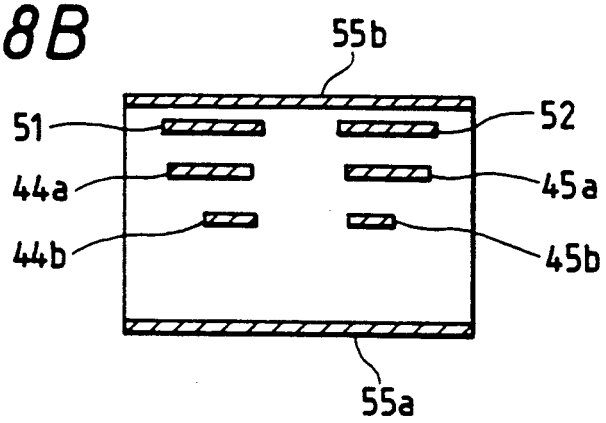
FIG. 8B is a cross sectional view taken on the line **8*b*—8*b* shown in FIG. 8A**.
Figure 8C:
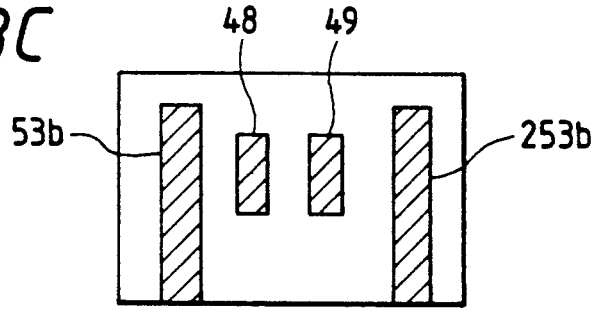
FIG. 8C is a side view of FIG. 8A.
Figure 8D:
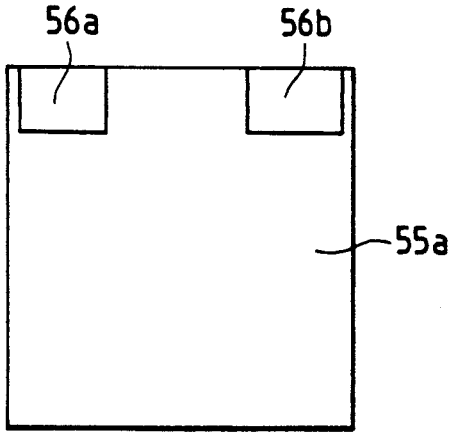
FIG. 8D is a plan view of the grounded conductor shown in FIG. 8A.

FIG. 8B is a cross sectional view taken along the line 8b—8b shown in FIG. 8A. FIG. 8C is a side view of FIG. 8A. FIG. 8D is a plan view of the grounded conductor 55 formed on the fourth layer dielectric substrate 54. In the grounded conductor 55a, there are notches 56a and 56b which are provided to prevent the side surface conductors 53b and 253b from shorting to the grounded conductor 55a.

The dielectric filter 8 is similar to the dielectric filter 1 of the first embodiment as to the frequency characteristics. Thus, this embodiment can be modified by the techniques described in the second to fifth embodiments (FIGS. 2-5). That is, this embodiment is applicable to the second to fifth embodiments as similar to the case of the sixth embodiment.

Hereinbelow will be described an eighth embodiment.

Basic structure of the dielectric filter is the same as the first embodiment.

Figure 9A:
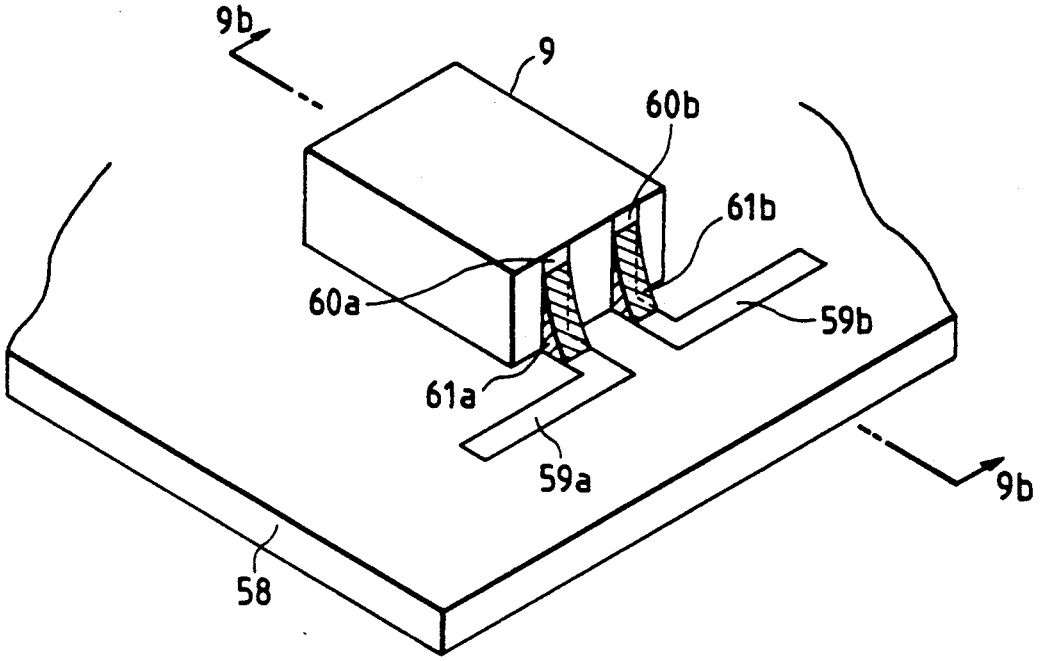
FIG. 9A is a perspective view of an eighth embodiment of a flat type dielectric filter.
Figure 9B:
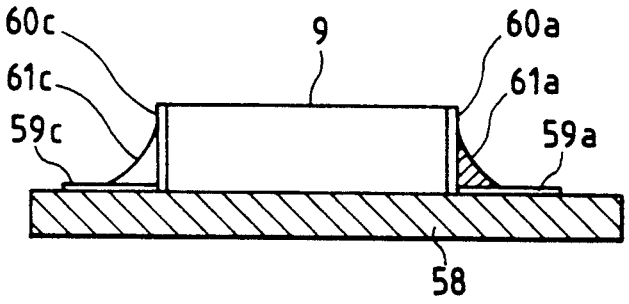
FIG. 9B is a cross-sectional view taken on the line **9*b*—9*b* in FIG. 9A**.

There is a difference from the first embodiment in the materials used for the side surface conductors. FIG. 9A is a perspective view of the eighth embodiment. FIG. 9B is a cross-sectional view taken along the line 9b—9b in FIG. 9A.

Figure 9C:
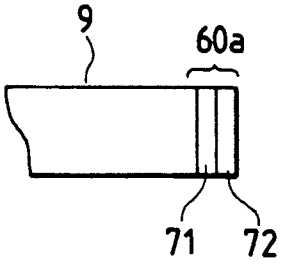
FIG. 9C is an enlarged view of a portion of the dielectric filter shown in FIG. 9A.

In FIG. 9A, the dielectric filter 9 is fixed on the printed circuit board 58 by soldering side surface conductors 60a, 60b, and 60c to printed patterns 59a, 59b, and 59c by masses of solder 61a, 61b, and 61c respectively. FIG. 9C is an enlarged view of a portion of the dielectric filter of this embodiment. In FIGS. 9B and 9C each of the side surface conductors 60a, 60b, and 60c comprises a first layer 71 and a second layer 72. Eight combinations of different materials shown in Table 3 for the side surface conductors 60a, 60b, and 60c are formed and estimated. Estimation is made with respect to melt the surface conductors 60a, 60b, and 60c in a soldering process and salt spray test. The soldering process is carried out under the condition that the filter 9 is heated to 250° C. for one minute at least.

TABLE 3

| 1ST LAYER | 2ND LAYER | MELT-BY-SOLDERING TEST EST. | | SALT AFTER SPRAY TEST EST. | |
|---|---|---|---|---|---|
| Ag | NO | NG | MELTED | NG | TURN TO BLK |
| Ag | Ni | GOOD | NOT MELTED | GOOD | NO CHANGE |
| Cu | NO | GOOD | NOT MELTED | NG | BLUE-GREEN CHANGE |
| Cu | Ag | GOOD | NOT MELTED | NG | BLUE-GREEN CHANGE |
| Cu | SOLDER | GOOD | NOT MELTED | GOOD | NO CHANGE |

As shown in Table 3, a dielectric filter having side surface conductors 60a, 60b, and 60c which comprise the first layer 101 made of silver and the second layer 102 made of nickel shows an excellent corrosion resistance. Moreover, a dielectric filter having the first layer made of copper and the second layer 102 made of solder shows also an excellent corrosion resistance. On the other hand, the filter having only a first layer 71 made of silver melts by soldering at 250° C. for one minute and corrosion under the salt-water test. Solder composed of about 63% of Pb and 37% of Sn can be used. Particularly, a solder composed of 90% of Sn and 10% of Pb is used as the second layer 72 for solder plating on the first layer 71.

Hereinbelow will be described the ninth embodiment.

Alumina glass type material is used as the dielectric material to form the dielectric filter as shown in FIG. 4. This material is formed and sintered as mentioned in the first embodiment. Then, it is formed by hot isostatic pressing (HIP) under the condition shown in Table 4.

TABLE 4

| HIP TEMP | HIP PRESSURE | FILLED GAS |
|---|---|---|
| 800° C. | 50 MPa | Ar |

The flat type dielectric filter obtained mentioned above is estimated and compared with the flat type dielectric filter which is not subjected to this HIP processing. Estimation is made with respect to dispersions of the center frequency of the pass band and of unloaded Q factor. The estimation result is shown in Table 5 where dispersion is represented by variance values and the number of the samples are thirty.

TABLE 5

| | CENT FREQ OF PASSBAND | | UNLOADED Q | |
|---|---|---|---|---|
| | MEAN VALUE [MHz] | DIS-PERSION [MHz] | MEAN VALUE | DIS-PERSION |
| WITHOUT HIP | 903.5 | ±9.3 | 9.8 | ±7 |
| HIP | | ±1.2 | 123 | ±2 |

As shown in Table 5, dispersion of the center frequency of the pass band with HIP processing lower than that of the prior art processing without HIP processing and dispersion of unloaded Q factor is less than one third of that the prior art without HIP processing.

Hereinbelow will be described the tenth embodiment.

Figure 10A:
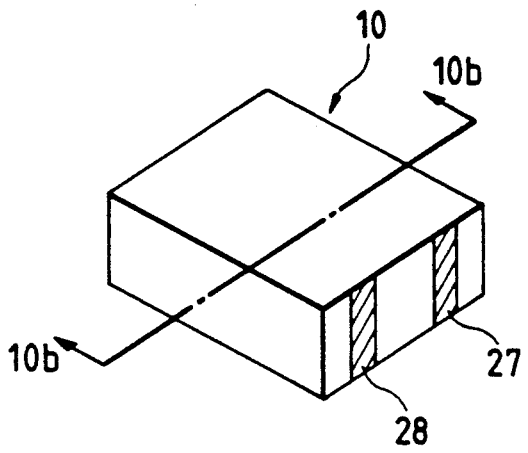
FIG. 10A is a perspective view of a flat type dielectric filter of a tenth embodiment.
Figure 10B:
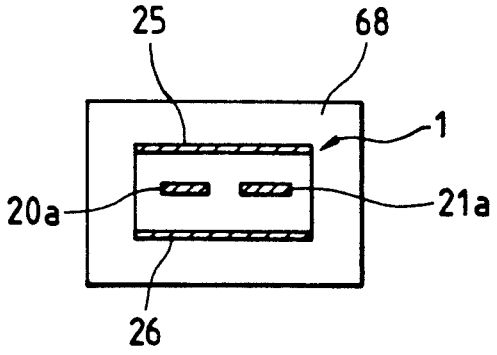
FIG. 10B is a cross-sectional view taken line **10*b*—10*b* shown in FIG. 10A**.

FIG. 10A is a perspective view of a flat type dielectric filter of the tenth embodiment. FIG. 10B is a cross-sectional view taken along line **10*b*—10*b* shown in FIG. 10A. In this embodiment, the flat type dielectric filter 1 described in the first embodiment is coated with a coat material 68. The coat material 68 is composed of an epoxy resin or a dielectric sintered substance. The dielectric filter 10 is not exposed except side surface conductors 28 and 29. That is, side surface of 19*a* and 19*b* are not coated with the epoxy resin 68**.

The flat type dielectric filter 10 is estimated with respect to the salt-water test with the varied kind of materials for the grounded conductors 25 and 26.

TABLE 6

| ELEC-TRODE | MOLD | SALT-SPRAY TEST EST. | |
|---|---|---|---|
| Ag | NO | NG | TURN TO BLK |
| Ag | DIELEC-TRONIC SUBSTANCE | G00D | NO CHANGE |
| Ag | EPOXY | GOOD | NO CHANGE |
| Cu | NO | NG | BLUE GREEN CHANGE |
| Cu | DIELEC-TRONIC SUBSTANCE | GOOD | NO CHANGE |
| Cu | EPOXY | GOOD | NO CHANGE |

As shown in Table 6, the grounded conductors 25 and 26 made of silver or copper do not show deterioration.

In this specification, all embodiments are described with dielectric filters comprising balanced-strip lines. However, this invention can be applied to dielectric filters comprising microstrips.

What is claimed is:

1. A flat type dielectric filter comprising:

two conducting plates spatially confronting each other at a given space;

a filter element having a substantially U-shaped strip line provided between said two conducting plates;

input/output electrodes confronting both ends of said U-shaped strip line respectively provided between said conducting plates; and a dielectric substance filling said given space, said input/output electrodes extending to a side surface of said dielectric substance, said U-shaped strip line being formed such that each center frequency of spurious output in spurious response deviates from each frequency odd number times a center frequency of passband of said dielectric filter.

2. A flat type dielectric filter as claimed in claim 1, wherein said U-shaped strip line comprises:

a first portion so curved to form an open loop; and two second portions each formed to have a larger width than said first portion, each of said second portions being provided to a corresponding one end of said first portion such that each of said second portions extends in the opposite direction to the other.

3. A flat type dielectric filter as claimed in claim 2, further comprising: two third portions each provided to a center portion of said U-shaped strip line such that each of said two third portions extends in the opposite direction to the other.

4. A flat type dielectric filter as claimed in claim 3, wherein said U-shaped strip line and said two third portions forms substantially a $\pi$-shape.

5. A flat type dielectric filter as claimed in claim 2, further comprising: two third portions each provided between said first and second portions, each of said third portions being formed such that the width of an end of each of said third portions facing said second portion is equal to that of said second portion and the width of the other end of each of said third portions facing said first portion is equal to that of said first portion.

6. A flat type dielectric filter as claimed in claim 5, further comprising: two fourth portion each provided to a center portion of said U-shaped strip line such that each of said fourth portions extends in the opposite direction to the other.

7. A flat type dielectric filter as claimed in claim 6, wherein said U-shaped strip line and said two fourth portions forms substantially a $\pi$-shape.

8. A flat type dielectric filter as claimed in claim 1, wherein said U-shaped strip line comprises:

a first portion so curved to form an open loop; and two second portions each formed to have a smaller width than said first portion, each of said second portions being provided to a corresponding end of said first portion.

9. A flat type dielectric filter as claimed in claim 1, wherein each end of said U-shaped strip line has a width which increases with distance from said each end.

10. A flat type dielectric filter as claimed in claim 1, wherein each end of said U-shaped strip line has a width which decreases with distance from said each end.

11. A flat type dielectric filter as claimed in claim 10, further comprising: two second portions, each provided to a center portion of said U-shaped strip line such that each of said second portions extends in the opposite direction to the other.

12. A flat type dielectric filter as claimed in claim 11, wherein said U-shaped strip line and said two second portions forms substantially a $\pi$ -shape.

13. A flat type dielectric filter comprising:

a first layer dielectric substrate;

a filter element having a substantially U-shaped strip line formed on said first layer dielectric substrate;

a second layer dielectric substrate formed on said first layer dielectric substrate and said U-shaped strip line, said second layer dielectric substrate having two electrode portions each located so as to confront a corresponding end of said U-shaped strip line to thereby couple capacitively thereto;

a third layer dielectric substrate formed on said second layer dielectric substrate and said two electrode portions; and two conducting plates sandwiching said first layer, second layer, and third layer dielectric substrates.

14. A flat type dielectric filter as claimed in claim 13, wherein said U-shaped strip line is formed such that each center frequency of spurious output in spurious response deviates from each frequency odd number times a center frequency of passband of said dielectric filter.

15. A flat type dielectric filter as claimed in claim 14, wherein said U-shaped strip line comprises:

a first portion so curved to form an open loop; and two second portions each formed to have a larger width than said first portion, each of said second portions being provided to a corresponding end of said first portion such that each of said second portions extends in the opposite direction to the other.

16. A flat type dielectric filter as claimed in claim 15, further comprising: two third portions each provided to a center portion of said U-shaped strip line such that each of said two third portions extends in the opposite direction to the other.

17. A flat type dielectric filter as claimed in claim 16, wherein said U-shaped strip line and said two third portions forms substantially a $\pi$-shape.

18. A flat type dielectric filter as claimed in claim 17, further comprising: two third portions each provided between said first and second portions, each of said third portions being formed such that the width of an end thereof facing said second portion is equal to that of said second portion and the width of the other end of each of said third portions facing said first portion is equal to that of first portion.

19. A flat type dielectric filter as claimed in claim 18, further comprising: two fourth portions each provided to a center portion of said U-shaped strip line such that each of said fourth third portions extends in the opposite direction to the other.

20. A flat type dielectric filter as claimed in claim 19, wherein said U-shaped strip line and said two fourth portions forms substantially a $\pi$-shape.

21. A flat type dielectric filter as claimed in claim 14, wherein said U-shaped strip line comprises:

a first portion so curved to form an open loop; and two second portions each formed to have a smaller width than said first portion, each of said second portions being provided to a corresponding end of said first portions.

22. A flat type dielectric filter as claimed in claim 14, wherein each end of said U-shaped strip line has a width which increases with distance from said each end.

23. A flat type dielectric filter as claimed in claim 14, wherein each end of said U-shaped strip line has a width which decreases with distance from said each end.

24. A flat type dielectric filter comprising:

a first layer dielectric substrate having a filter element comprised of an open loop strip line, each end of said open loop strip line extends to an edge of said first layer dielectric substrate;

a second layer dielectric substrate formed on said first layer dielectric substrate, said second layer dielectric substrate having two strip lines thereon, and side surface conductors formed on a side surface of said second layer dielectric substrate such that said each end of said open loop strip line is connected to each of said strip lines:

a third layer dielectric substrate formed on said second layer dielectric substrate, said third layer dielectric substrate having two electrode portions located to confront said strip lines to respectively capacitively couple thereto;

a fourth layer dielectric substrate formed on said third layer dielectric substrate; and two conducting plates sandwiching said first layer, second layer, third layer, and fourth layer dielectric substrates.

25. A flat type dielectric filter comprising:

a first dielectric substrate;

a filter element having a substantially U-shaped strip line formed on said first dielectric substrate;

two input/output electrodes formed on said first dielectric substrate each confronting a corresponding end of said U-shaped strip line, each of said input/output electrodes extending to an edge of said first dielectric substrate;

a second dielectric substrate covering said first dielectric substrate, said U-shaped strip line, and said two input/output electrodes;

two conducting plates sandwiching said first and second dielectric substrates, said U-shaped strip line, and said two input/output electrodes, said two conducting plates and said first and second dielectric substrates, said U-shaped strip line, and said two input/output electrodes forming a block; and two terminal portions formed on a side surface of said block including said edge such that each of said terminal portions is connected to a corresponding one of said two input/output electrodes, each of said two terminal portions comprising a first layer formed on said side surface and a second layer formed on said first layer.

26. A flat type dielectric filter as claimed in claim 25, wherein said first layer is made of silver and said second layer is made of nickel.

27. A flat type dielectric filter as claimed in claim 25, wherein said first layer is made of copper and said second layer is made of solder.

28. A flat type dielectric filter as claimed in claim 25, further comprising a coat layer for coating over at least said two conducting plates.

29. A flat type dielectric filter as claimed in claim 28, wherein said coat layer is made of epoxy resin.

30. A flat type dielectric filter as claimed in claim 28, wherein said coat layer is made of a dielectric substance.

31. A flat type dielectric filter comprising:

a first dielectric substrate;

a filter element having a substantially U-shaped strip line formed on said first dielectric substrate;

two input/output electrodes formed on said first dielectric substrate, each of said input/output electrodes confronting a corresponding end of said U-shaped strip line, each of said input/output electrodes extending to an edge of said first dielectric substrate;

a second dielectric substrate covering said first dielectric substrate, said U-shaped strip line, and said two input/output electrodes; and two conducting plates sandwiching said first and second dielectric substrates, said U-shaped strip line being formed such that each center frequency of spurious output in spurious response deviates from each frequency odd number times a center frequency of passband of said dielectric filter.

* * * * *